United States Patent [19]

Sakamoto

[11] Patent Number: 4,466,140

[45] Date of Patent: Aug. 21, 1984

[54] ADJUSTABLE TOILET BOWL SEAT AND FOOTREST

[76] Inventor: Minoru Sakamoto, 3911 Nioi Place, Honolulu, Hi. 96816

[21] Appl. No.: 479,806

[22] Filed: Mar. 28, 1983

[51] Int. Cl.[3] ..... E03D 11/00

[52] U.S. Cl. ..... 4/254

[58] Field of Search ..... 4/254, 237, 234; 297/429, 430, 423, 431

[56] References Cited

U.S. PATENT DOCUMENTS

| | | | |
|---|---|---|---|
| 775,029 | 11/1904 | Dezandorf | 4/254 |
| 2,127,020 | 8/1938 | Carlson | 297/429 |
| 2,470,258 | 5/1949 | Mustafa | 297/429 |
| 2,499,884 | 3/1950 | Singleton | 297/430 X |
| 4,175,294 | 11/1979 | Boyd | 4/237 |
| 4,254,514 | 3/1981 | Sakamoto | 4/237 X |

*Primary Examiner*—Henry K. Artis

*Attorney, Agent, or Firm*—Harvey B. Jacobson

[57] ABSTRACT

A cantilever mount is provided including an upper rear portion for removable engagement behind the upper forward lip of a toilet bowl and a lower portion having rearwardly facing surfaces for abutment against forwardingly facing surfaces of the front portion of a toilet bowl below the upper lip thereof. A pair of opposite side laterally spaced apart and forwardly projecting generally horizontal arms have the rear ends thereof mounted from opposite sides of the mount with the front arm ends projecting forwardly from the mount. A multiposition footrest is supported between the front ends of the arms for angular displacement relative thereto about a horizontal axis extending between the arm front ends. The footrest includes at least one pair of footrest surfaces facing generally radially outwardly of the axis of angular displacement of the footrest relative to the arms and angularly spaced about the axis with the footrest surfaces being spaced different radial distances from the axis. The footrest and arms include coacting structure whereby the footrest may be rotated between selected positions with different footrest surfaces facing in an upward direction. The rear ends of the arms are supported from opposite sides of the mount for angular adjustment relative thereto whereby the height of the footrest may be adjusted. In addition, spacing blocks are provided whereby the open seat of the associated toilet bowl may be blocked in a slightly forwardly and upwardly inclined position.

12 Claims, 3 Drawing Figures

ADJUSTABLE TOILET BOWL SEAT AND FOOTREST

BACKGROUND OF THE INVENTION

Field of the Invention

Various forms of toilet bowl seats heretofore have been provided for assisting a person using a toilet in completing a successful bowel movement. Inasmuch as it is well recognized by the medical field that the ordinary comfortable seating position is not nearly as helpful for a proper movement of the bowel as is a squatting position, several of these previously known attachments are specifically designed to enable the user of the toilet to assume a substantially squatting position while attempting a bowel movement. These previously known forms of attachments include these disclosed in U.S. Pat. Nos. 559,304, 906,053, 2,099,188 and 4,254,514. In addition, various other forms of toilet bowl attachments including some of the general structural and operational features of the instant invention are disclosed in U.S. Pat. Nos. 1,215,104, 1,525,864, 1,737,163, 2,518,272, 2,698,440, 2,752,610, 2,954,566, 3,171,138, 3,383,714 and 4,205,404. In addition, a squatting position facilitating toilet bowl seat is disclosed in U.S. Pat. No. Des. 2,333,523.

However, these previously kown forms of toilet seats for facilitating the user assuming a squatting position while attempting a bowel movement do not include structure whereby the extent of the squatting position to be achieved by the user of an associated toilet may be adjusted according to the desires and/or physical capacity of the user. Accordingly, a need exists for an improved squat position facilitating toilet bowl seat.

BRIEF DESCRIPTION OF THE INVENTION

The adjustable footrest of the instant invention is constructed in a manner to provide an upwardly facing footrest surface forward of and slightly below the forward upper lip of a toilet bowl whereby a person using the toilet bowl may assume a substantially squatting position while attempting a bowel movement. The footrest is adjustable in that the footrest defining portion thereof is rotatably supported from a suitable mounted removably supported from the associated toilet bowl and with the footrest defining portion being rotatable about a horizontal transverse axis and defining of plurality of footrest surfaces spaced about and facing outwardly away from the axis of the rotation of the footrest defining portion with the footrest surfaces being spaced different distances from the aforementioned axis. In this manner, persons of different size and physical suppleness may adjust the footrest in a manner such that a near squatting position may be assumed for facilitating easy and more complete bowel movements. In addition, the invention further includes spacing block structure whereby an open seat supported from and registered with the open upper end of an associated toilet bowl may be propped in a slightly forwardly and upwardly inclined position to further facilitate a user of the invention assuming a substantially fully squatting position.

The main object of this invention is to provide a toilet bowl footrest which will enable the user to readily accomplish a bowel movement and which includes adjustment structure whereby the footrest may be adjusted according to the size and physical suppleness of the user.

Another object of this invention is to provide a toilet bowl footrest in accordance with the immediately preceding object and constructed in a manner whereby the footrest will not interfere with utilization of the associated toilet in the conventional manner.

The further object of this invention is to provide a footrest which is readily movably supported from the associated toilet bowl.

A final object of this invention to be specifically enumerated herein is to provide a toilet bowl footrest in accordance with the preceding objects and which will perform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
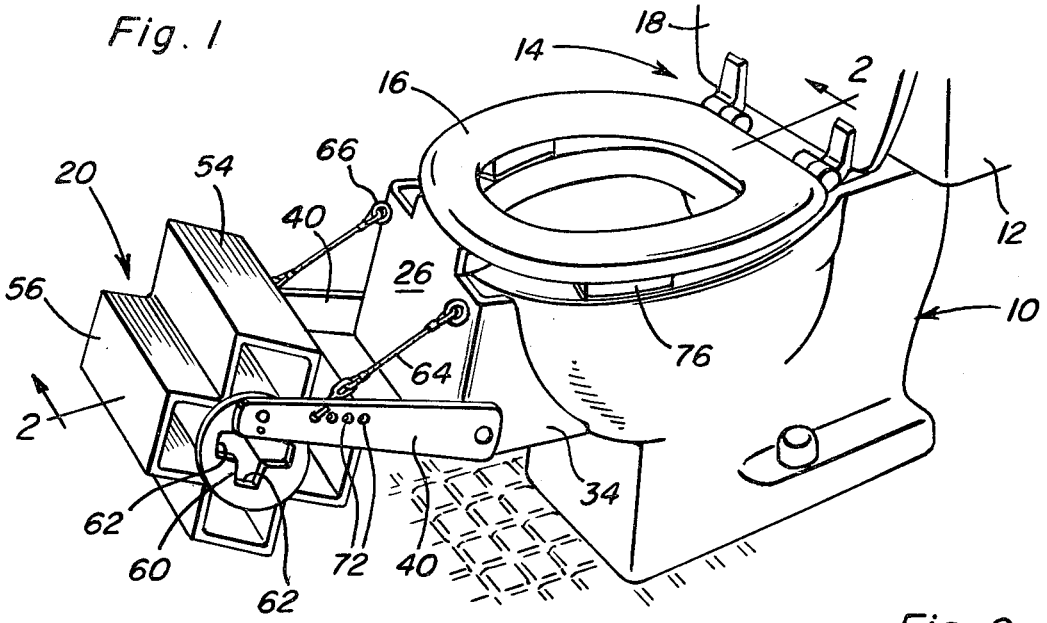
FIG. 1 is a perspective view of a conventional form of floor mounted toilet bowl with the footrest of the instant invention operatively supported therefrom.

Referring now more specifically to the drawings the numeral 10 generally designates a conventional floor mounted form of toilet bowl supporting a water tank 12 therefrom and a seat assembly of conventional design referred to in general by the reference numeral 14 and including an open hinged seat 16 and a hinged cover 18, all of the foregoing being considered as conventional.

The footrest assembly of the instant invention is referred to in general by the reference numeral 20 and includes a cantilever mount referred to in general by the reference numeral 22. The mount 22 includes an upstanding formed panel member 24 including front and rear sides 26 and 28 and which includes a rearwardly and downwardly directed upper hook portion 30 hooked over and rearwardly behind the upper forward lip portion of the open upper end of the toilet bowl 10. The panel member includes a lower portion provided with rearwardly directed opposite side portions 34 between which an abutment block 36 is supported in any convenient manner and the rearward edges or surfaces of the opposite side portions 34 and abutment block 36 abut the opposing forwardly facing surfaces 38 of the forward portion of the bowl 10. In this manner, the cantilever mount 22 is removably supported from a toilet bowl 10.

A pair of opposite sides support arms 40 are provided and include rear ends pivotally supported from the opposite side panels 34 and the abutment block 36 as at 42 and forward ends which support indexing blocks 42 therefrom on the inner sides thereof by fasteners 44. In addition, an elongated brace 46 is secured and extended between the forward ends of the arms 40 and also passes through the indexing blocks 42.

A footrest member referred to in general by the reference numeral 48 is provided and comprises a horizontally elongated tubular member of cruciform cross-section defining four circumferentially spaced and outwardly projecting footrest surfaces 50, 52, 54 and 56. The opposite ends of the footrest member 48 include mounting disc portions 58 supported therefrom and each mounting disc portion 58 includes a cruciform opening 60 formed therein. Each of the openings 60 defines four circumferentially spaced recesses 62 and the footrest member 48 may be positioned with the indexing blocks 42 seatingly received in a corresponding pair of recesses 62 in order to support the footrest member 48 in stationary position relative to the forward ends of the arm 40. In each indexed position of the footrest member 48 is defined by the indexing blocks 42, one of the footrest surfaces 50, 52, 54 and 56 faces upwardly in a slightly forwardly and upwardly inclined attitude. In addition, a pair of inclined braces 64 are anchored between opposite side anchor eyes 66 carried by opposite side upper portions of the panel member 24 and hook members 70 releasably engaged in a selected pair of corresponding longitudinally spaced apertures 72 formed in the arms 40. Accordingly, the inclined braces 64 may be utilized to anchor the arms 40 in various angularly displaced positions relative to the panel member 24.

Figure 2:
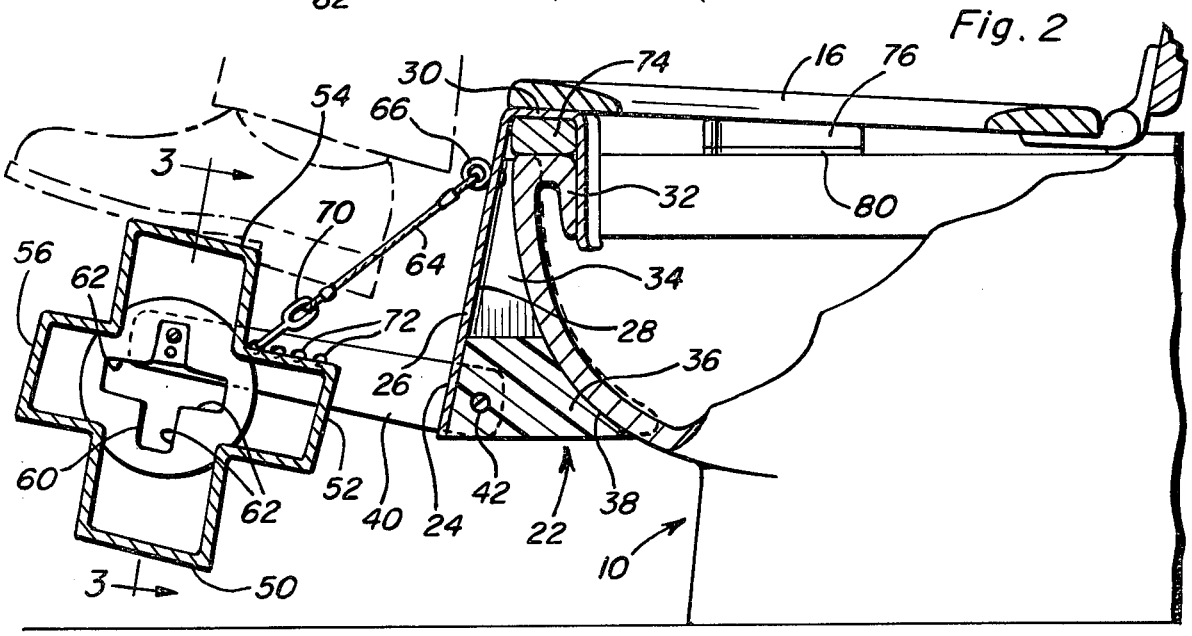
FIG. 2 is an enlarged fragmentary vertical sectional view taken substantially upon the plane indicated by the sectional line 2—2 of FIG. 1.
Figure 3:
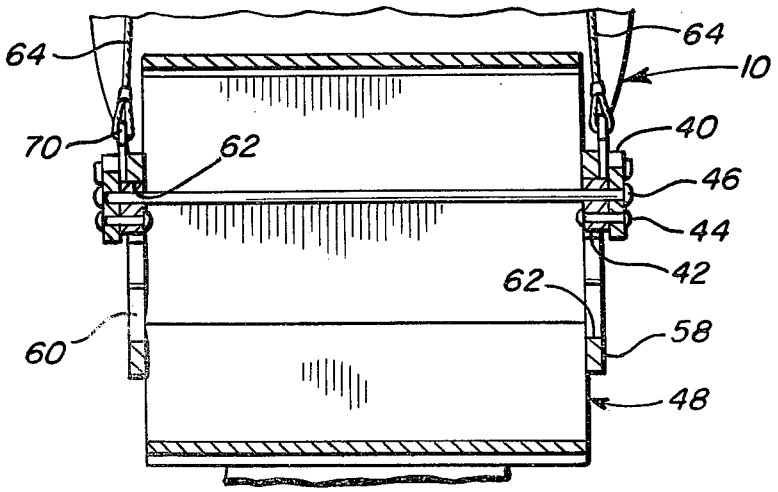
FIG. 3 is a further enlarged vertical sectional view taken substantially upon the plane indicated by the sectional line 3—3 of FIG. 2.

It will be noted from FIG. 2 of the drawings that the surfaces 50, 52, 54 and 56 are spaced different distances from the center of the cruciform openings 60. Accordingly, when the footrest member 48 is disposed in different indexed positions relative to the arms 40 by reception of the indexing blocks 42 in a selected pair of the recesses 62, the upwardly facing footrest surfaces thereof will be spaced at different elevations relative to the seat 16. Accordingly, a person seated on the seat 16 may achieve different "squatting positions".

From FIGS. 1 and 2 of the drawings it may be seen that a spacing block 74 is disposed beneath the forward marginal edge of the seat and the upper rim of the forward portion of the bowl 10. The hook portion 30 passes over and behind the spacing block 74. Further, a pair of opposite side inclined to spacing blocks 76 are positioned beneath opposite side portions of the seat 16 and the opposing upper surfaces of the bowl 10. In this manner, the seat 16 may be supported in a slightly forwardly and upwardly inclined position thereby facilitating a person using the toilet to assume a squatting position through utilization of the footrest 20.

It is to be noted that the channel lever mount 22, arms 40 and footrest member 48 may all be constructed of plastic material. Further, the spacing blocks 74 and 76 may be similarly constructed and either disposed in position merely resting upon the upper rim bowl 10 or adhesively supported therefrom such as by an adhesive layer 80.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A toilet bowl assembly including an upwardly opening bowl member adapted to support an open seat member therefrom in vertical alignment with and above the open upper portion of said bowel and with said bowl defining front, rear and opposite side portions, a footrest assembly, said footrest assembly including a cantilever mount defining an upper portion removably engaged behind the upper lip of the front portion of said bowl and a lower portion having rearwardly facing surfaces abutted against forwardly facing surfaces of said front portion of said bowl below said upper lip, a pair of opposite side laterally spaced apart forwardly projecting generally horizontal arms including corresponding front and rear ends, means mounting the rear ends of said arms from opposite side portions of the lower portion of said mount with the front ends of said arms projecting forwardly from said mount, a multi-position footrest supported between the front ends of said arms for angular displacement relative thereto about a horizontal axis extending therebetween, said footrest including at least one pair of footrest surfaces facing generally radially outwardly of said axis and angularly spaced thereabout, said surfaces being spaced different radial distances from said axis.

2. The toilet bowl assembly of claim 1 wherein said arms and footrests include coacting releasably engageable means operative to lock said footrest in selected angularly displaced positions relative to said arms with different footrest surfaces thereof facing upwardly.

3. The toilet bowl assembly of claim 1 wherein said arms are supported from said cantilever mount for angular displacement relative thereto about axis extending transversely of said mount for angular displacement relative thereto about axis extending transversely of said mount and arms, and means operatively connected between said arms and mount for retaining said arms in adjusted angularly displaced positions.

4. The toilet bowl assembly of claim 1 wherein said footrest is generally cruciformed in cross-sectional shape and defines four outwardly facing and defines four outwardly facing footrest surfaces spaced about said axis.

5. The toilet bowl assembly of claim 4 wherein said cruciform footrest is hollow and the opposite ends thereof include mounting plate portions provided with central openings of cruciform shape defining four peripherally spaced inwardly opening recesses, the free ends of said arms including indexing blocks supported from the inner sides thereof selectively receivable in a pair of corresponding recesses.

6. The toilet bowl assembly of claim 5 wherein said arms and footrests include coacting releasably engageable means operative to lock said footrest in selected angularly displaced positions relative to said arms with different footrest surfaces thereof facing upwardly.

7. The toilet bowl assembly of claim 5 wherein said arms are supported from said cantilever mount for angular displacement relative thereto about axis extending transversely of said mount and arms, and means operatively connected between said arms and mount for retaining said arms is adjusted angularly displaced positions.

8. The toilet bowl of assembly of claim 1 wherein the upper open end of said toilet bowl includes an open seat hingedly supported from the rear portion thereof, spacing block means interposed between the underside of said seat and the upper end of said bowl supporting said seat in a slightly forwardly and upwardly inclined position.

9. The toilet bowl assembly of claim 8 wherein said spacing block means includes a spacing block disposed between the forward extremity of said open seat and the opposing upper surfaces of the forward portion of said bowl, said upper portion of said mount defining a downwardly opening hook which is hook engaged over said spacing block.

10. A footrest assembly including a pair of generally parallel arms including first and second pairs of corresponding ends, said first pair of said corresponding ends being supported from a suitable support structure, said second pair of corresponding ends including indexing means supported therefrom, a horizontally elongated tubular footrest disposed and extending between said second ends of said arms and supported therefrom for angular displacement about an axis extending between said second set of ends, said indexing means and said tubular footrest including coacting portions releasably engageable with each other for selectively retaining said footrest in adjusted angularly displaced positions relative to said arms.

11. The footrest of claim 10 wherein said tubular footrest defines a plurality of circumferentially spaced outwardly facing footrest surfaces spaced different distances outwardly of the axis of angular displacement of said footrest relative to said arms.

12. In combination with a toilet bowl assembly including an upwardly opening bowl member defining front, rear and opposite side portions, generally horizontal arm means including front and rear ends, means mounting the rear end of said arm means from said bowl, a multiposition footrest supported from the front end of said arm means for angular displacement relative thereto about a horizontal transverse axis, said footrest including at least one pair of footrest surfaces facing generally radially outwardly of said axis and angularly spaced thereabout, said surfaces being spaced different radial distances from said axis.

* * * * *